US005341125A

United States Patent [19]

Plonsky et al.

[11] Patent Number: 5,341,125

[45] Date of Patent: Aug. 23, 1994

[54] DEACTIVATING DEVICE FOR DEACTIVATING EAS DUAL STATUS MAGNETIC TAGS

[75] Inventors: Christopher B. Plonsky, Boca Raton; Brent F. Balch, Oakland Park; David Fallin, Coral Springs, all of Fla.

[73] Assignee: Sensormatic Electronics Corporation, Deerfield Beach, Fla.

[21] Appl. No.: 820,972

[22] Filed: Jan. 15, 1992

[51] Int. Cl.[5] ..... G08B 13/14; A63F 9/02; H01F 13/00

[52] U.S. Cl. ..... 340/572; 186/61; 335/284

[58] Field of Search ..... 340/572, 825.31-825.34; 364/478; 235/383; 186/61; 335/284; 343/895

[56] References Cited

U.S. PATENT DOCUMENTS

| | | | |
|---|---|---|---|
| 3,820,104 | 6/1974 | Fearon | 340/572 |
| 3,938,044 | 2/1976 | Lichtblau | 340/572 |
| 4,141,078 | 2/1979 | Bridges, Jr. et al. | 364/900 |
| 4,498,076 | 2/1985 | Lichtblau | 340/572 |
| 4,684,930 | 8/1987 | Minasy et al. | 340/572 X |
| 4,689,590 | 8/1987 | Heltemes | 335/284 |
| 4,728,938 | 3/1988 | Kaltner | 340/572 |
| 4,752,758 | 6/1988 | Heltemes | 335/284 |
| 4,769,631 | 9/1988 | Copeland | 340/572 X |
| 4,881,061 | 11/1989 | Chambers | 340/568 |
| 4,882,569 | 11/1989 | Dey | 340/572 |
| 5,008,649 | 4/1991 | Klein | 340/572 |
| 5,059,951 | 10/1991 | Kaltner et al. | 240/572 |
| 5,126,720 | 6/1992 | Zhou et al. | 340/572 |
| 5,142,292 | 8/1992 | Chang | 340/572 X |
| 5,170,045 | 12/1992 | Bengtsson | 340/572 X |

FOREIGN PATENT DOCUMENTS

| | | |
|---|---|---|
| 0112493 | 7/1984 | European Pat. Off. . |
| 0457078 | 11/1991 | European Pat. Off. . |

*Primary Examiner*—John K. Peng
*Assistant Examiner*—Thomas J. Mullen, Jr.
*Attorney, Agent, or Firm*—Robin, Blecker, Daley & Driscoll

[57] ABSTRACT

A deactivating device for deactivating a dual status EAS tag for use in an EAS system in which the device utilizes a detection field for detecting the presence of an active tag in a detection/deactivation zone and in which the device further utilizes a deactivation field which is matched to the detection field.

16 Claims, 3 Drawing Sheets

DEACTIVATING DEVICE FOR DEACTIVATING EAS DUAL STATUS MAGNETIC TAGS

FIELD OF THE INVENTION

This invention relates to a deactivating device for deactivating dual status tags used in electronic article surveillance (EAS) systems, and in particular, to an apparatus and method which increases the ease and/or reliability of deactivating dual status tags.

BACKGROUND OF THE INVENTION

Electronic article surveillance (EAS) systems are known in which dual status EAS tags are attached to articles to be monitored. One type of dual status EAS tag comprises a length of high permeability, low coercive force magnetic material which is positioned substantially parallel to a length of a magnetizable material used as a control element. When an active tag, i.e. one having a demagnetized control element, is placed in an alternating magnetic field, which defines an interrogation zone, the tag produces a detectable valid tag signal. When the tag is deactivated by magnetizing its control element, the tag may produce a detectable signal which is different than the detectable valid tag signal.

Methods and apparatus for magnetizing the control element, thereby deactivating the tag, are described in U.S. Pat. No. 4,684,930. In the '930 patent, a series of permanent magnets are arranged on a convex curved outer surface of a rotatable cylinder. To deactivate the tag, the tag is rolled over the outer surface of the rotatable cylinder so that the permanent magnets of the cylinder come closely adjacent to and thereafter move away from the tag. In this way, the control element of the tag is magnetized.

The deactivating device of the '930 patent is mechanically complex in that the permanent magnets must be mounted on the outer surface of the cylinder and the cylinder must be mounted so as to freely rotate. After repeated deactivation operations, due to repeated mechanical contact with the tags, the outer surface of the cylinder is subject to wear. Still further, the deactivating device of the '930 patent requires operator intervention to effect the deactivation of the tag (i.e., the operator moving the tag over the deactivating device to rotate the cylinder.) Accordingly, the deactivation device of the '930 patent does not easily lend itself to an automated deactivation process.

A deactivation device is known which uses an electromagnet, which when energized forms a deactivating electromagnetic field in a deactivation area to magnetize the control elements of tags placed therein. Such deactivation devices are currently used in, for example, library EAS systems. In such library systems, a photocell is arranged to detect the presence of a book in the deactivation area. Responsive to the detection by the photocell, the electromagnet is energized thereby producing the deactivating electromagnetic field. The photocell advantageously prevents the electromagnet from being continuously energized thereby reducing the power consumption of the deactivation device.

In the above deactivation technique, while the photocell detects the presence of a book in the deactivation area, such detection does not indicate whether a tag is attached to the book. Further, in the case where a tag is attached to the book, the detection by the photocell fails to indicate whether the tag is active or deactivated. Accordingly, the electromagnet will not only be energized when a book having an active tag is placed in the deactivation area, but will also be energized when a book without a tag, or with a deactivated tag, is placed in the deactivation area.

When using a deactivating electromagnetic field to deactivate tags, for proper deactivation to occur the tag must be passed through the deactivation area in a proper orientation relative to the deactivating electromagnetic field. However, in the above technique using a photocell, the photocell only detects the presence of the book and fails to detect the presence or orientation of an attached tag. Accordingly, the deactivating electromagnetic field is formed even when the tag is not properly oriented for effective deactivation within the deactivation area.

It is, therefore, a primary objective of the present invention to provide an improved device for detecting and deactivating dual status type tags of an EAS system.

It is a further object of the present invention to provide an improved deactivation device in which the orientation of a deactivating field for deactivating a tag substantially matches a detection field for detecting the presence of a tag.

It is still a further object of the present invention to provide a deactivation device incorporated into a checkout apparatus for deactivating tags.

SUMMARY OF THE INVENTION

In accordance with the principles of the present invention, the above and other objectives are realized in a deactivating device for an EAS system in which the deactivating device comprises a detection means for detecting an activated EAS tag located within a detection/deactivation area and a deactivating means for deactivating the active EAS tag. The detection means comprises transmitting means for transmitting a predetermined detection field in the detection/deactivation area and means for sensing a response signal caused by the active EAS tag interacting with the predetermined detection field.

The deactivating means forms a predetermined deactivating field having a configuration preselected relative to the detection field such that the deactivating field is able to deactivate a tag at a deactivating position related to a detection position at which the detection field is able to result in a response signal from the tag. This can be accomplished by configuring the deactivation field such that at the deactivation position the orientation of its component in at least a given one of the three orthogonal planes defining the detection/deactivation area is substantially matched to the orientation of the component of the detection field at the detection position in the given plane. In this way, when a tag is oriented in the detection/deactivation area so as to be detectable by the detection field, the tag is also oriented for effective deactivation by the deactivating field.

Also disclosed is a deactivating device as described above where the means for deactivating the active EAS tag operates in response to detection of the active EAS tag by the detection means. In this way, the deactivation means is not operated unless an active EAS tag is first detected in the detection/deactivation area.

In a further embodiment of the invention, the deactivation device is incorporated into a transporting means for transporting an article having an attached EAS tag through the detection/deactivation area. In a specific embodiment, the transporting means is shown as a conveyor belt for carrying the article and the detecting means and the deactivation means are positioned under the conveyor belt. In this way, the deactivation procedure can be automated.

In the embodiments of the invention to be disclosed, the deactivation position can be substantially at the detection postion or at a preset offset from the detection postion. In the latter case, the operation of the deactivating means is delayed for a predetermined time period after detection of the EAS tag. The predetermined time period substantially corresponds to the time required for the tag to be moved the preset offset distance.

Also disclosed is a deactivation device, as described above, which is adapted to communicate with a point-of-sale device of a checkout system and which further comprises an inhibiting means. In response to the point-of-sale device, the inhibiting means prevents the operation of the deactivation device until the article having the attached tag is properly registered at the point-of-sale device. In this way, unauthorized deactivations of EAS tags is prevented.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
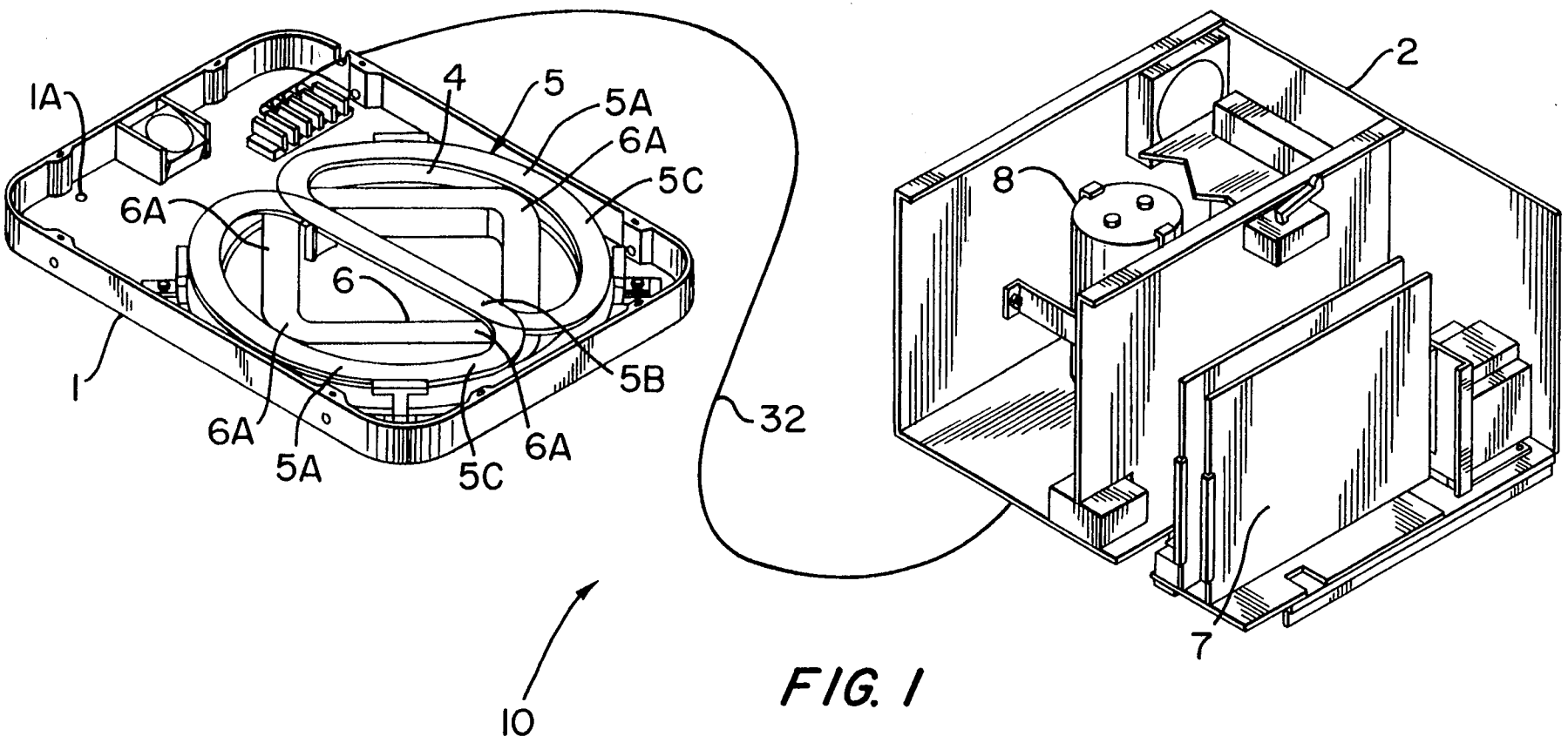
FIG. 1 illustrates a deactivation device in accordance with the principles of the present invention.

FIG. 1 shows a deactivating device 10 in accordance with the principles of the present invention. As illustrated, the deactivation device 10 comprises a detector/deactivator pad 1 and a power pack unit 2. The detector/deactivator pad 1 comprises a detection transmitting coil 4, a detection receiving coil 5, and a deactivating coil 6, all of which are fixed in a substantially parallel or coplanar relationship. The power pack 2 comprises a power supply 8 and an electronics section 7.

As shown, the coil 4 is a planar coil of circular configuration. The coil 6 is of square configuration and coplanar with the coil 4. Also, as shown, the coil 6 is inscribed within the col 4, with the vertices 6A of the coil 6 abutting the inner surfaces of the coil 4. However, the coil 6, instead of being inscribed within the coil 4, could be configured to circumscribe the coil 4, if desired.

The coil 5 includes two adjacent planar coil parts 5A each of which is parallel to the coils 4 and 6. Each coil part 5A has a straight segment 5B which extends between opposite vertices 6A of the coil 6 and a semicircular or arcuate segment 5C which connects the ends of the respective straight segment 5B and follows the circular contour of the coil 4. In conventional practice, the coil parts 5A are connected out-of-phase so as to cancel any transmit field which may be coupled thereto from the coil 4.

Figure 2A:
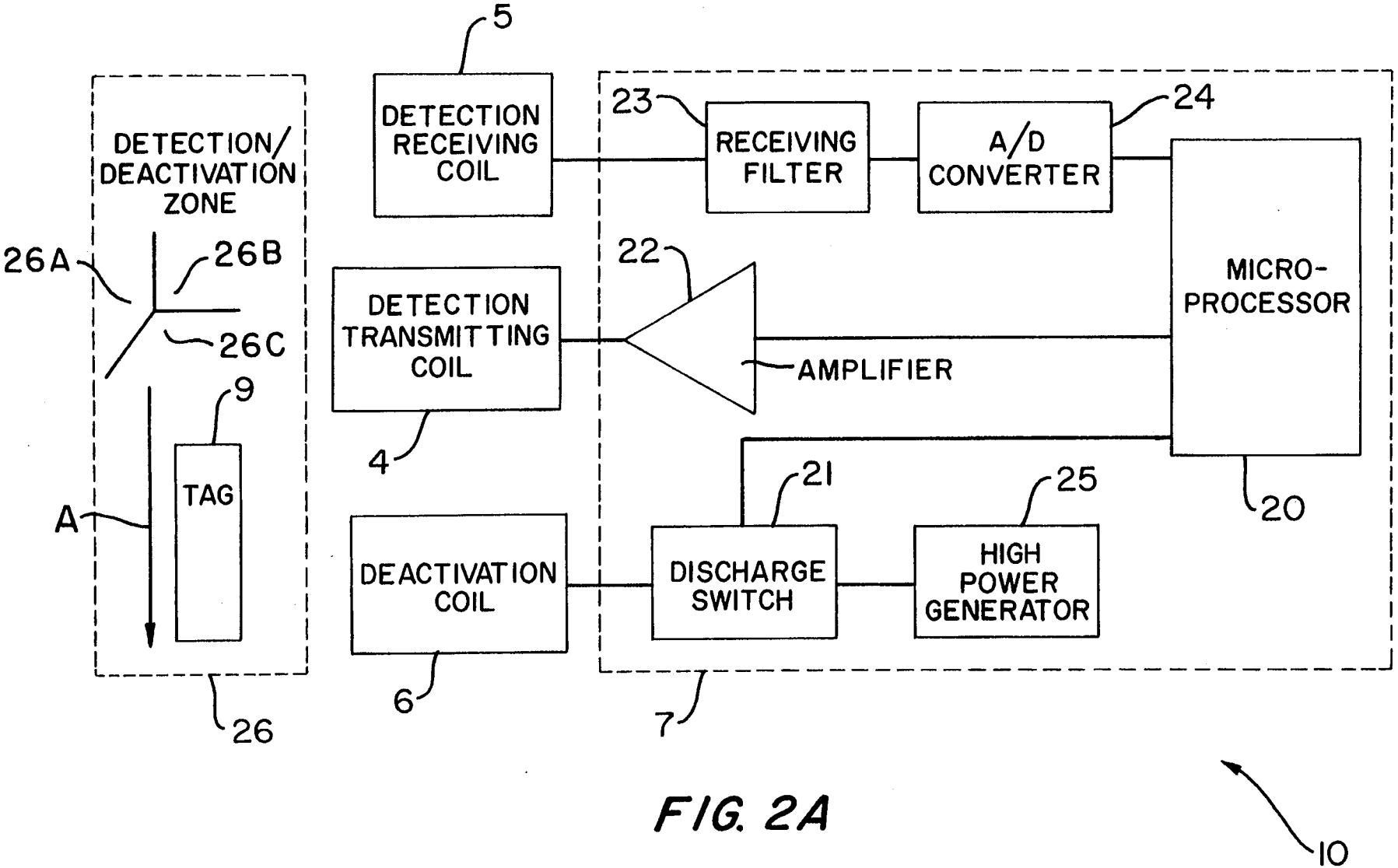
FIG. 2A shows in block diagram form the deactivation device of FIG. 1.
Figure 2B:
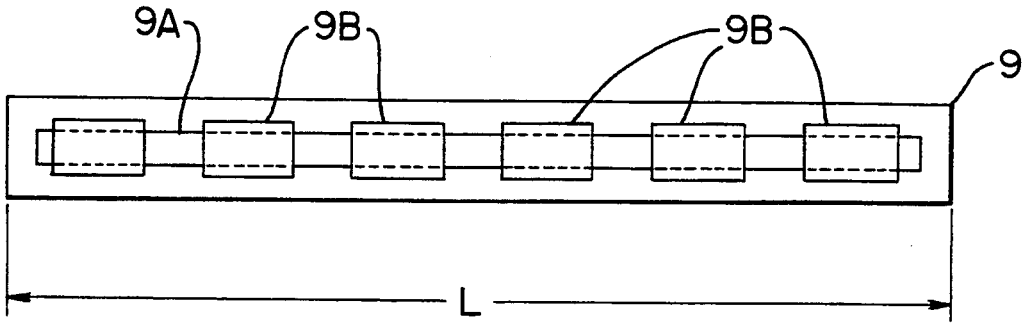
FIG. 2B shows a dual type EAS tag in greater detail.

FIG. 2A shows in block diagram form the deactivating device 10 of FIG. 1 in greater detail. The device 10 defines a detection/deactivation zone or area 26 in which a dual status type EAS tag 9 can be detected and then deactivated. FIG. 2B shows a typical form of the tag 9 in greater detail. As shown, the tag comprises a response element 9A which can be a high permeability, low coercive force magnetic material. Positioned substantially overlapping and adjacent to the response element 9A are control elements 9B which can be comprised of a magnetizable material. Since the characterisitcs and operation of tags like the deactivatable tag 9 are well known, further description thereof is omitted.

For detecting the presence of the tag 9 in the zone 26, the detection transmitting coils 4 are driven at a predetermined frequency by an amplifier 22 which, in turn, is driven by a signal generated by a microprocessor 20. When driven by the amplifier 22, the detection transmitting coils 4 form an alternating magnetic detection field in the zone 26.

It is well known that to cause the tag 9 to generate a detectable response signal, the flux lines of the magnetic detection field must pass through the high permeability, low coercive force magnetic material (response element 9A) of the tag 9 in substantially the lengthwise L direction of the tag 9. Accordingly, to ensure detection of the tag 9, the detection transmitting coils 4 are shaped so that the detection field formed is characterized by having along the path A of travel of the tag 9 in the zone 26 magnetic flux lines in each of the three mutually orthogonal reference planes, shown pictorially in FIG. 2A as planes 26A, 26B and 26C, defining the three dimensional space of the zone 26.

The flux lines of the detection field in each plane need not be at the same point or position along the path A, but each plane must contain flux lines at some position. As a result, regardless of the orientation of the tag 9 along the path A, there will be at least one position at which the magnetic flux lines of the detection field are substantially parallel to the lengthwise direction of the tag. In this way, when the tag 9 is in an active state and traverses the zone 26 along the path A, the tag 9 will generate a detectable response signal in at least one position along the path.

The detection receiving coils 5 are arranged to receive magnetic flux changes in the zone 26 and, thus, the detectable response signal generated by the tag 9. The received signals are coupled by the coil 5 to receiving filters 23 which isolate the detectable response signal generated by the tag. The output of the receiving filters 23 is converted from an analog to a digital signal by A/D converter 24. The digital signal output from the A/D converter 24 is provided to microprocessor 20 which determines when the received detectable response signal is greater than a threshold level, thereby detecting the presence of the tag 9 in the zone 26.

Upon detecting that the tag 9 is present in the detection/deactivation zone 26, the microprocessor 20 initiates a deactivating sequence by closing a discharge switch 21. The discharge switch 21 connects the output of a high power generator 25 to the deactivating coil 6. This results in a current flow in the deactivating coil which causes a deactivating electromagnetic field to be formed in the detection/deactivation zone 26.

In accordance with the invention, the deactivating coils 6 are configured so that the deactivating electromagnetic field generated thereby substantially matches the range and the orientation of the magnetic detection field formed by the detecting transmitting coils 4. In this way, for positions or points within the zone 26 the direction of the magnetic flux lines of the deactivating field are in substantially the same direction as the magnetic flux lines of the magnetic detection field.

As a result, when the tag 9 is in a position in which the detection field results in a detectable response signal and, hence, has flux lines along the length of the tag, the flux lines of the deactivating field if generated will also be along the tag length. Application of the deactivating field at this detection position will thus establish flux lines along the length of the magnetizable control element (control element 9B) of the tag magnetizing the element and, therefore, deactivating the tag. Accordingly, with the deactivating field matched to the detection field, detection of the tag 9 at any detection position along the path A and subsequent application of the deactivating field will result in deactivation of the tag at a deactivation position which is substantially at the detection position.

Figure 3:
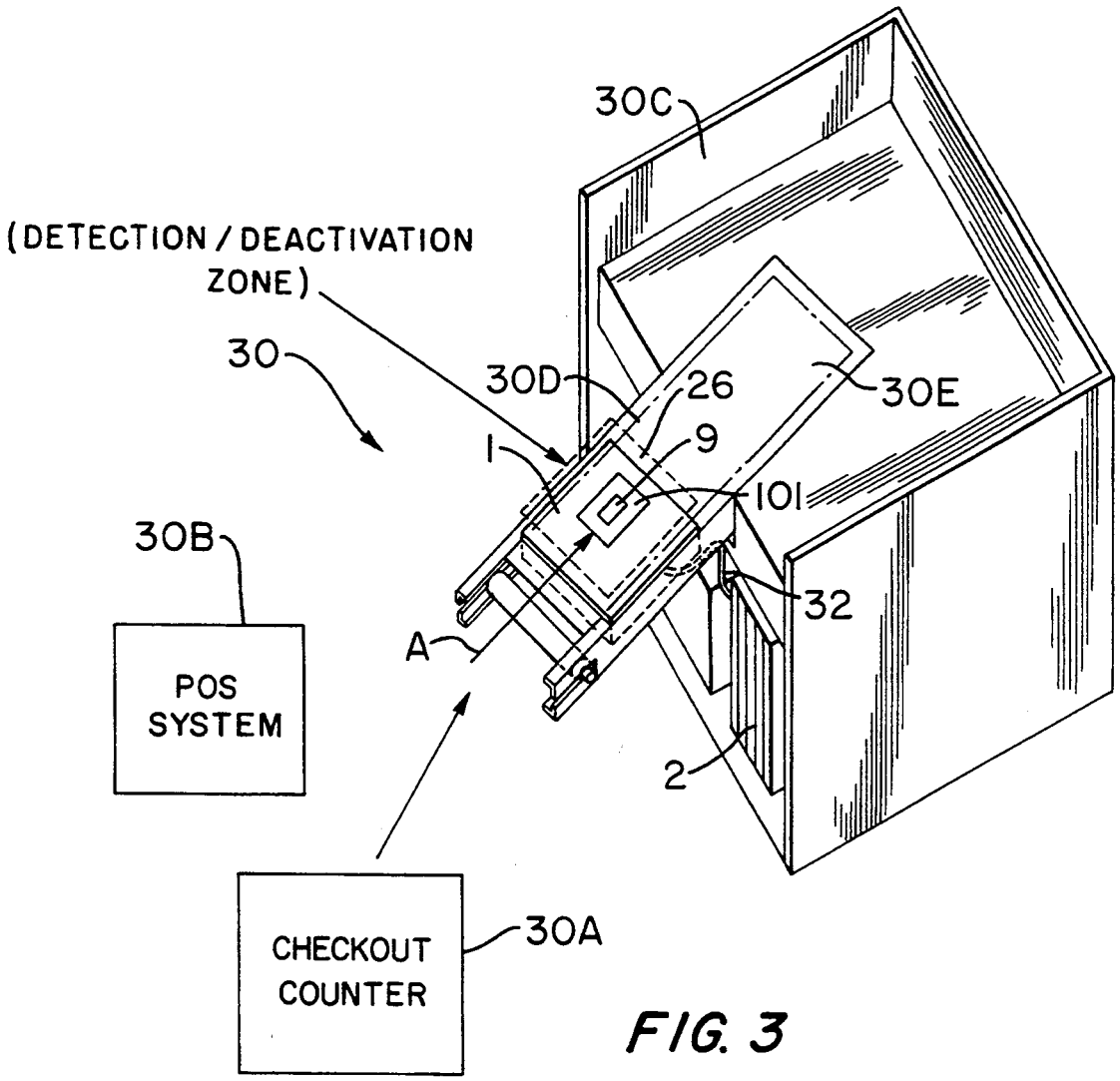
FIG. 3 shows an embodiment where the deactivation device of FIG. 1 is incorporated into a conveyor belt of a checkout system.

FIG. 3 shows the deactivating device 10 of FIGS. 1 and 2 incorporated into a point-of-sale checkout system 30 employing a checkout counter 30A, a point-of-sale (POS) unit 30B and a packaging station 30C. In particular, the detector/deactivator pad 1 of the device 10 is mounted under a conveyor belt 30D of the checkout system with the top plane surface 1A of the pad 1 in a nearly parallel relationship to the flat carrying surface 30E of the conveyor belt. The conveyor belt 30D carries articles having attached tags 9 along the path A through the detection/deactivation zone or area 26 formed by the pad 1. The power pack 2 of the deactivating device 10 is housed in the base of the packaging station 30C and is connected to the pad 1 by a cable 32.

In operation, a tag 9 to be deactivated is carried on an article 101 which is transported by the belt 30D through the detection/deactivation zone 26 of the pad 1. Regardless of the orientation of the tag 9 in relationship to the pad 1, when the conveyor belt advances the tag 9 along path A through the zone 26, the tag 9 reaches a position where the flux lines of the magnetic detection field generated by the pad substantially flow through the lengthwise direction L of the tag 9. As a result, the tag 9 generates a detectable signal which is received by the detection receiving coil 5 of the pad and detected by the microprocessor 20.

The microprocessor 20 thereupon causes the switch 21 to connect the high power generator 25 to the deactivating coil 6. This causes the deactivating coil 6 to generate the deactivating field which, as above-described, is substantially matched to the detection field. Assuming that the advance speed of the conveyor belt 30D is relatively slow as compared to the time between detecting the tag 9 and forming the deactivating field, at the time the deactivating field is formed, the tag 9 is still at a deactivating position along the path A that is substantially the same as the detection position where the tag 9 was detected. As a result, the deactivating field will be correctly oriented to magnetize the control element 9B of the tag 9, thereby deactivating the tag.

As can appreciated from the foregoing description, articles being checked out at the point-of-sale checkout system 30 of FIG. 3 and having attached tags 9 which are to be deactivated, can be placed on the conveyor belt 31 in any orientation and be subsequently deactivated by the deactivating device 10. The operator is thus relieved of any requirement to locate and properly orient the tag. Further, when a tag 9 which is already deactivated traverses the zone 26 on the conveyor belt 30D, a detectable signal is not received and, therefore, the deactivating field is not formed. Accordingly, the power consumption of the deactivating device 10 is reduced and the operable lifetime of the deactivating device 10 is increased.

The deactivating device 10 of FIG. 3 can also be further adapted so that its microprocessor 20 interacts with the POS unit 30B of the checkout system 30. In particular, the microprocessor 20 can be adapted to inhibit the above-described detection and/or deactivation operation of the deactivating device 10 until information is received from the POS unit indicating that a valid item has been entered for checkout. When such information is received by the microprocessor, it then enables the detection and deactivation operation of the deactivating device 10 until a tag 9 is detected and successfully deactivated. Thereafter, the microprocessor again inhibits detection and deactivation until the next valid item is entered at the POS unit. In this way, unauthorized use of the deactivation system is prevented.

In the above-described embodiments, the deactivating electromagnetic field and the detection field are substantially matched in orientation. This means that each field will have components, in each of the three orthogonal planes defining the zone 26, which correspond to components of the other field. However, the invention is intended to cover matching of these fields such that at corresponding detection and deactivation positions each field need only have a component in at least one of the planes in which the other field has a component. In such a case, for proper operation of the system, it is preferable to restrict the orientation of the tag 9 so that its length will be parallel to a plane in which both the detection and deactivating fields have the matched components.

In a further aspect of the present invention, the deactivating device 10 is further adapted such that after an attempt to deactivate a tag 9 occurs, the detection sequence is repeated after a predetermined time period (the predetermined time period being relatively short in comparison to the advance of the tag 9 along the path A so that the tag is substantially in the same position as when the initial detection occurred) to verify that the tag 9 has indeed been deactivated. If it is detected that the tag 9 is still activated, the deactivating operation is repeated. In this way, deactivation is verified, and where deactivation fails, multiple attempts can be made to deactivate the tag. If after a predetermined number of attempts the tag 9 will not deactivate or verify as being deactivated, an appropriate warning signal is initiated by the microprocessor 20.

In yet a further aspect of the present invention, the detection field and the deactivating field of the deactivating device, while matched as above-described, are offset from each other so that a deactivating position is now at a predetermined offset distance from its corresponding detection position along the path A. In this case, when a tag 9, which is traversing the detection/deactivating zone 26 moving at a predetermined speed, is detected by the microprocesor 20, the microprocessor delays for a predetermined time period before causing the deactivating field to be generated.

This predetermined time period is set to correspond to the time period required for the tag to advance the offset distance separating the detection and deactivating fields. As a result, when the deactivation field is generated the tag has advanced to a deactivating position where the orientation of the deactivating field substantially corresponds to the orientation of the detection field at the detection position, thereby allowing the tag 9 to be deactivated.

In the above-described embodiment of FIG. 3, a conveyer belt 30D is used to carry the articles and the attached tags 9 through the detection/deactivation zone 26. However, it is understood that various other types of transporting systems can be used for moving the tag 9 provided that the transporting system maintains the tag in a substantially fixed orientation while traversing the zone.

Still further, the advantages of the present invention are also provided in cases where the deactivating device 10 is free standing, and no conveyor belt, or other mechanical transporting system is provided. In such cases, the operator transports the article and attached tag 9 through the detection/deactivating zone 26 generally along the path A, while keeping the tag in a generally fixed orientation. In these situations, the reliability of detection and deactivation will be somewhat reduced.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A deactivation device for use in an EAS system utilizing a deactivatable type EAS tag, for deactivating an active EAS tag positioned in a detection/deactivation area defined by three orthogonal reference planes, said deactivation device comprising:

means for detecting the presence of an active EAS tag in the detection/deactivation area, said means for detecting comprising means for transmitting a predetermined detection field into the detection/-deactivation area and means for sensing a signal from said active EAS tag when said active EAS tag is situated at a detection position in said detection/deactivation area in response to said detection field, said detection position being a position in said detection/deactivation area at which the detection field results in a response signal from said active EAS tag, and said detection field at said detection position having components in said three orthogonal planes; and means for deactivating said active EAS tag comprising means for transmitting a deactivating field into the detection/deactivation area, said deactivating field having a configuration preselected in relationship to said detection field such that the deactivating field deactivates said active EAS tag when said active EAS tag is situated at a deactivating position which is at a preset offset distance from said detection position and at which said deactivating field has components having orientations matched to the orientations of said components of said detection field at said detection position in said three orthogonal planes.

2. A deactivation device for use in an EAS system utilizing a deactivatable type EAS tag, for deactivating an active EAS tag positioned in a detection/deactivation area defined by three orthogonal reference planes, said deactivation device comprising:

means for detecting the presence of an active EAS tag in the detection/deactivation area, said means for detecting comprising means for transmitting a predetermined detection field into the detection/-deactivation area and means for sensing a signal from said active EAS tag when said active EAS tag is situated at a detection position in said detection/deactivation area in response to said detection field, said detection position being a position in said detection/deactivation area at which said detection field results in a response signal from said tag;

means for deactivating said active EAS tag, said deactivating means being responsive to said detection of said tag in the detection/deactivation area by said detection means and comprising means for transmitting a deactivating field into the detection/deactivation area, said deactivating field having a configuration preselected in relationship to said detection field such that the deactivating field deactivates said active tag when said active tag is situated at a deactivating position in said detection/deactivation area; and means for delaying for a predetermined period of time, measured from the detection of said tag, the operation of said deactivating means.

3. A deactivation device in accordance with claim 2 wherein:

said deactivating position is at a preset offset distance from said detection position;

and said predetermined period of time is related to the time it takes said active tag to travel said predetermined offset distance.

4. A deactivation device for use in an EAS system utilizing a deactivatable type EAS tag, for deactivating an active EAS tag positioned in a detection/deactivation area defined by three orthogonal reference planes, said deactivation device comprising:

transport means for transporting an article having said active EAS tag attached thereto through the detection/deactivation area, said transport means comprising a moving conveyor belt for carrying said article and said attached tag through the detection/deactivation area;

means for detecting the presence of said active EAS tag in the detection/deactivation area, said means for detecting comprising means for transmitting a predetermined detection field into the detection/-deactivation area and means for sensing a signal from said active EAS tag when said active EAS tag is situated at a detection position in said detection/deactivation area in response to said detection field, said detection position being a position in said detection/deactivation area at which the detection field results in a response signal from said active EAS tag;

means for deactivating said active EAS tag comprising means for transmitting a deactivating field into the detection/deactivation area, said deactivating field having a configuration preselected in relationship to said detection field such that the deactivating field deactivates said active tag when said active tag is situated at a deactivating position which is at a preset offset distance from said detection position, said preset offset distance being in a direction corresponding to the movement of said conveyor belt;

and means for delaying for a predetermined period of time the operation of said deactivating means, said predetermined period of time corresponding to the time it takes said conveyor belt to move a distance corresponding to said preset offset distance.

5. A deactivation device for use in an EAS system utilizing a deactivatable type EAS tag, for deactivating an active EAS tag positioned in a detection/deactivation area defined by three orthogonal reference planes, said deactivation device comprising:

means for detecting the presence of an active EAS tag in the detection/deactivation area, said means for detecting comprising means for transmitting a predetermined electromagnetic detection field into the detection/deactivation area, said detection field transmitting means comprising a transmitting coil, and means for sensing a signal from said active EAS tag when said active EAS tag is situated at a detection position in said detection/deactivation area in response to said detection field, said detection position being a position in said detection/-deactivation area at which the detection field results in a response signal from said active EAS tag, and said sensing means comprising a receiving coil;

means for deactivating said active EAS tag comprising means for transmitting a deactivating electromagnetic field into the detection/deactivation area, said deactivating field having a configuration preselected in relationship to said detection field such that the deactivating field deactivates said active tag when said active tag is situated at a deactivating position in said detection/deactivation area, said deactivation field transmitting means comprising a deactivation coil;

said transmitting and deactivation coils being positioned in a common plane;

and said receiving coil being positioned in a plane parallel to said common plane.

6. A deactivation device in accordance with claim 5 wherein:

said transmitting coil is circular;

said deactivation coil is square and is one of inscribed within and circumscribed around said circular transmitting coil;

and said receiving coil comprises first and second coil sections having respective first and second overlapping straight segments which extend centrally and between opposing vertices of said square coil and respective third and fourth arcuate segments which connect opposite ends of said first and second straight segments, respectively, and follow the circular contour of said transmitting coil.

7. A deactivation device for use in an EAS system utilizing a deactivatable type EAS tag, for deactivating an active EAS tag positioned in a detection/deactivation area defined by three orthogonal reference planes, said deactivation device comprising:

means for detecting the presence of an active EAS tag in the detection/deactivation area, said means for detecting comprising means for transmitting a predetermined detection field into the detection/-deactivation area and means for sensing a signal from said active EAS tag when said active EAS tag is situated at a detection position in said detection/deactivation area in response to said detection field, said detection position being a position in said detection/deactivation area at which the detection field results in a response signal from said active EAS tag;

means for deactivating said active EAS tag comprising means for transmitting a deactivating field into the detection/deactivation area, said deactivating field having a configuration preselected in relationship to said detection field such that the deactivating field deactivates said active tag when said active tag is situated at a deactivating position in said detection/deactivation area; and verification means, operating responsive to the operation of the deactivation means, for causing the detection means to detect whether the tag, which has been previously subjected to the deactivation field, is still activated, said verification means causing said deactivating means to operate in response to said detection means detecting that the tag is still activated and said verification means cyclically operating the detecting means and the deactivating means until it is detected that said activated tag is deactivated to said verification means cyclically operates a predetermined number of times.

8. Apparatus comprising:

a deactivation device for use in an EAS system utilizing a deactivatable type EAS tag, for deactivating an active EAS tag positioned in a detection/deactivation area, the deactivation device comprising: transport means for transporting the active EAS tag through the detection/deactivation area; means arranged to detect the presence of the active EAS tag in the detection/deactivation area as said tag is being transported by said transport means; and means arranged to deactivate the active EAS tag positioned in the detection/deactivation area as said tag is being transported by said transport means.

9. Apparatus in accordance with claim 8 wherein said transport means comprises a moving conveyor belt.

10. Apparatus in accordance with claim 9, wherein:

said detecting means and said deactivating means are positioned under said moving conveyor belt.

11. Apparatus in accordance with claim 10 wherein:

said detecting and deactivating means are positioned between a top moving section and a bottom moving section of said conveyor belt.

12. Apparatus in accordance with claim 9 wherein:

said apparatus further comprises a checkout system which includes said transport means.

13. Apparatus in accordance with claim 12 wherein:

said checkout system further comprises a point-of-sale unit for verifying whether entry of an article bearing said tag to said checkout system is valid.

14. Apparatus in accordance with claim 13 wherein:

said deactivating device further comprises:

inhibiting means for inhibiting the operation of at least one of said means for detecting and said means for deactivating, said inhibiting means being disabled responsive to a communication from said point-of-sale unit indicating a valid entry of said article.

15. Apparatus in accordance with claim 13 wherein:

said checkout system includes a checkout counter in which said transport means is situated.

16. A method for use with a deactivatable type EAS tag used in an EAS system having a detection/deactivation area defined by three orthogonal reference planes, said method comprising:

transporting said active EAS tag through said detection/deactivation area;

detecting when an active EAS tag is positioned in said detection/deactivation area, comprising the steps of:

a. transmitting a predetermined detection field into the detection/deactivation area; and b. sensing a responsive signal from said tag resulting from interaction of said tag and said detection field when said tag is situated at a detection position in said detection/deactivation area, said detection position being a position in said detection/deactivation area at which the detection field results in a response signal from the active EAS tag; and deactivating said tag positioned in said detection/-deactivation area, comprising the step of:

transmitting a deactivating field into the detection/-deactivation area, said deactivating field having a configuration which is at a preset offset distance from said detection field such that the deactivating field deactivates said active EAS tag when said active EAS tag is at a deactivating position which is at a preset offset distance from said detection position, and said deactivating is delayed from said detecting for the time period it takes to transport said active EAS tag said offset distance.

* * * * *